US010272398B2

(12) United States Patent
Zhang

(10) Patent No.: US 10,272,398 B2
(45) Date of Patent: Apr. 30, 2019

(54) STATIC FLOW MIXER WITH MULTIPLE OPEN CURVED CHANNELS

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 550 days.

(21) Appl. No.: 14/934,753

(22) Filed: Nov. 6, 2015

(65) Prior Publication Data

US 2017/0128894 A1 May 11, 2017

(51) Int. Cl.
*B01F 3/02* (2006.01)
*B01F 5/06* (2006.01)

(52) U.S. Cl.
CPC ..... *B01F 5/0602* (2013.01); *B01F 3/02* (2013.01); *B01F 5/0616* (2013.01)

(58) Field of Classification Search
USPC ..... 366/336, 338, 339; 48/189.4
See application file for complete search history.

(56) References Cited

U.S. PATENT DOCUMENTS 1,113,041 A 10/1914 Murphy
4,495,858 A 1/1985 Erickson
4,592,201 A 6/1986 Dusa et al.
4,981,368 A * 1/1991 Smith ..... B01F 5/0473 366/337
5,839,828 A * 11/1998 Glanville ..... B01F 5/0473 366/340
5,884,472 A 3/1999 Presz, Jr. et al.
6,314,721 B1 * 11/2001 Mathews ..... F02K 1/46 181/213
7,041,218 B1 * 5/2006 Liles ..... B01F 5/0646 209/434
7,043,898 B2 5/2006 Rago
7,434,384 B2 * 10/2008 Lord ..... B64D 33/06 181/220
7,595,029 B2 * 9/2009 Welp ..... B01F 5/0643 422/129
7,810,335 B2 10/2010 Dussillols et al.
7,854,123 B2 * 12/2010 Au ..... F02K 1/386 181/213
7,882,696 B2 * 2/2011 Anderson ..... F01D 25/28 181/220
7,887,764 B2 * 2/2011 Jernberg ..... B01F 7/00041 366/273
8,141,353 B2 * 3/2012 Zheng ..... B01F 3/04049 239/432
8,322,144 B2 * 12/2012 Quarin ..... F02K 1/386 60/226.1
8,439,013 B2 5/2013 Bellis
(Continued)

OTHER PUBLICATIONS

Zhang, Xiaogang, "Exhaust Gas Mixer," U.S. Appl. No. 14/823,700, filed Aug. 11, 2015, 47 pages.

*Primary Examiner* — Mark Halpern
(74) *Attorney, Agent, or Firm* — Julia Voutyras; McCoy Russell LLP

(57) ABSTRACT

Methods and systems are provided for mixing gas in a flow passage by mounting a static flow mixer inside the flow passage. The static flow mixer may include a plurality of open and curved channels. The open and curved channels may mix the gas in multiple directions in the flow passage.

17 Claims, 10 Drawing Sheets

(56) References Cited

U.S. PATENT DOCUMENTS

| | | | | |
|---|---|---|---|---|
| 8,745,978 | B2 * | 6/2014 | Vanvolsem | B01D 53/90 366/336 |
| 8,801,362 | B2 * | 8/2014 | Presz, Jr. | F03D 1/04 415/2.1 |
| 9,447,717 | B2 * | 9/2016 | Mital | B01F 5/0473 |
| 9,718,037 | B2 * | 8/2017 | Harmon | B01F 5/0473 |
| 2008/0106968 | A1 * | 5/2008 | Schanz | B01F 5/0475 366/134 |
| 2011/0310697 | A1 * | 12/2011 | Hirschberg | B01F 3/06 366/337 |
| 2014/0077400 | A1 | 3/2014 | Sampath et al. | |
| 2014/0133268 | A1 | 5/2014 | Cornaglia et al. | |

* cited by examiner

STATIC FLOW MIXER WITH MULTIPLE OPEN CURVED CHANNELS

FIELD

The present description relates generally to systems for mixing device.

BACKGROUND/SUMMARY

In an effort to meet emissions standards, various sensors may be included in an engine exhaust system to estimate tailpipe emissions and/or enable accurate control over various exhaust emission control devices. Accurate measurement of exhaust gas compounds may enhance the operation of exhaust treatment systems, such as Selective Catalytic Reduction (SCR) units, as well as enable accurate air-fuel ratio feedback control. However, accurate sensor readings assume an even distribution of compounds in an exhaust stream in order to use a sampled measurement to be extrapolated to the compound concentrations in the full stream. Exhaust as in the exhaust manifold or immediately downstream of the exhaust manifold may include a non-homogeneous mixture of constituents due to the pulsed nature of the release of exhaust gas from each cylinder. For example, the exhaust gas from a given cylinder may not adequately mix with exhaust gas from another cylinder until each respective exhaust gas stream has traveled relatively far down the exhaust passage. As different cylinders may experience different combustion conditions (e.g., different fuel injection amounts, ignition timing, cylinder pressures, etc.), exhaust constituents may not be evenly distributed throughout the exhaust manifold and/or exhaust passage. Consequently, there may be a discrepancy between the concentration of an exhaust gas constituent as estimated by a sensor in the exhaust, and the concentration of the constituent in the bulk exhaust gas, particularly when the exhaust sensor is positioned in a close-coupled position to the exhaust manifold. Thus, the accuracy of the sensor may be degraded, leading to degraded engine emissions.

Attempts to address the problem of homogenous gas mixing in the exhaust passage of an engine include placing static flow mixers in the exhaust passage, an example of which is shown in US 2014/0133268. Therein, an annular support with radial vanes converging towards a center opening introduces a swirl in the exhaust gas, promoting mixing of exhaust gas with injected reductant while minimizing backpressure via the center opening.

However, the inventors herein have recognized potential issues with such systems. As one example, localized pockets of unmixed exhaust gas may persist downstream of the mixer, due to the center opening and mixing of exhaust gas in only one direction. Thus, the exhaust may not be homogenous for accurate sensor output.

To mitigate the problem of poor mixing of exhaust gas in an exhaust passage, the inventors herein describe a static flow mixer including a plurality of open channels coupled to a central support structure, each open channel of the plurality of open channels having a head bending in a first direction along a longitudinal axis, a tail bending in a second direction along the longitudinal axis, and set of lobes at the tail.

In one embodiment, the plurality of open channels may include at least one diverge channel and least one converge channel. Bends in the converge channels and in the diverge channels may create a flow path that moves exhaust gas from one plane of the exhaust passage to a second plane of the exhaust passage, such as from the peripheral area to the center area of the exhaust passage and vice versa.

In this way, the open converging channels and the open diverging channels coupled to a central support may improve gas flow mixing by moving the gas from the center of the exhaust passage to the periphery of the exhaust passage through the diverge channels, and by moving the gas from the periphery to the center of the exhaust passage through the converge channels. Additionally, the converge channels and diverge channels may include lobes at the channel tail, which may direct the exhaust gas exiting the tail of the channels in a clockwise and counter-clockwise direction, resulting in a more homogenous gas mix and increasing accuracy of sensor output.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
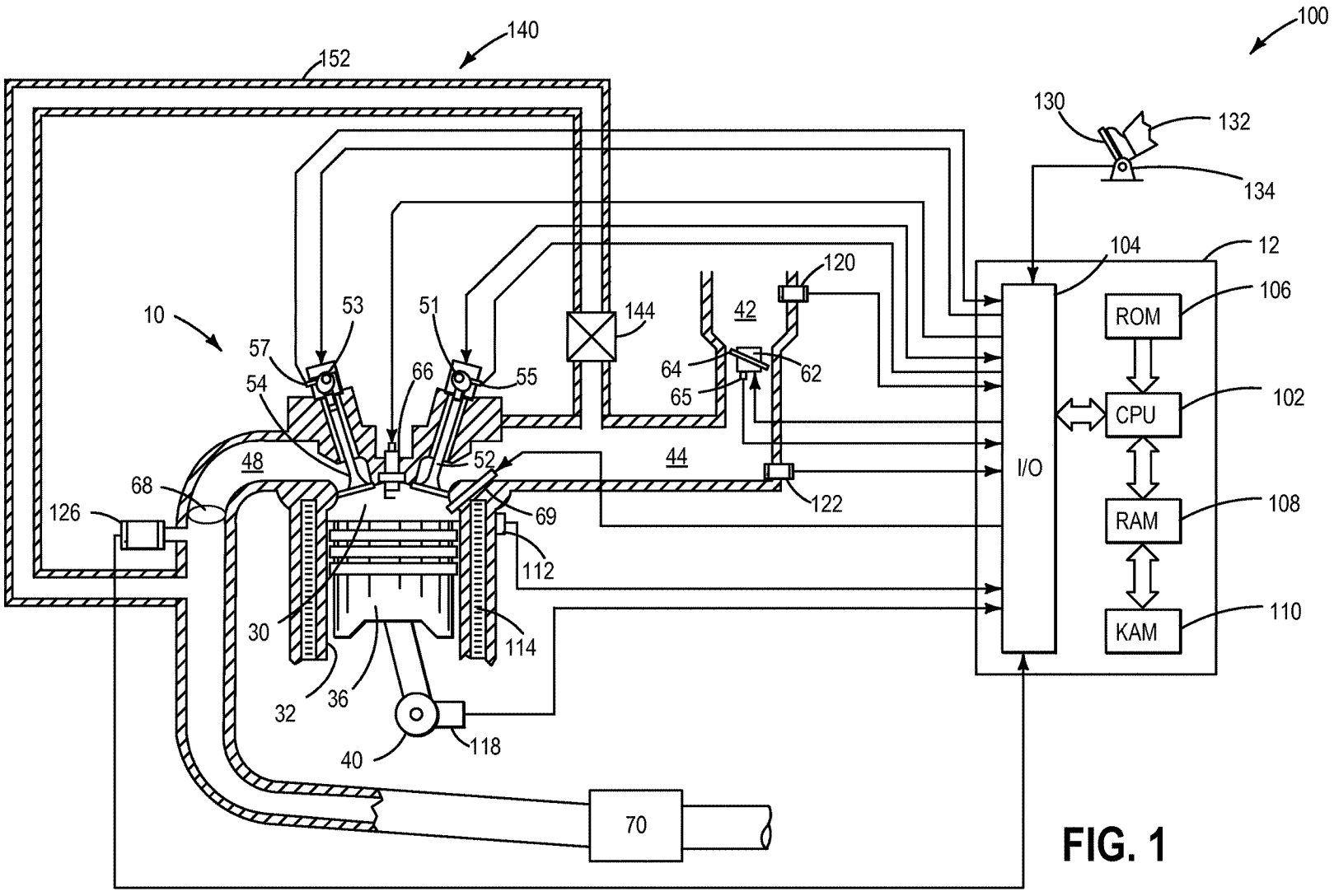
FIG. 1 illustrates an example of an engine with an exhaust passage housing a flow mixer.
Figure 2:
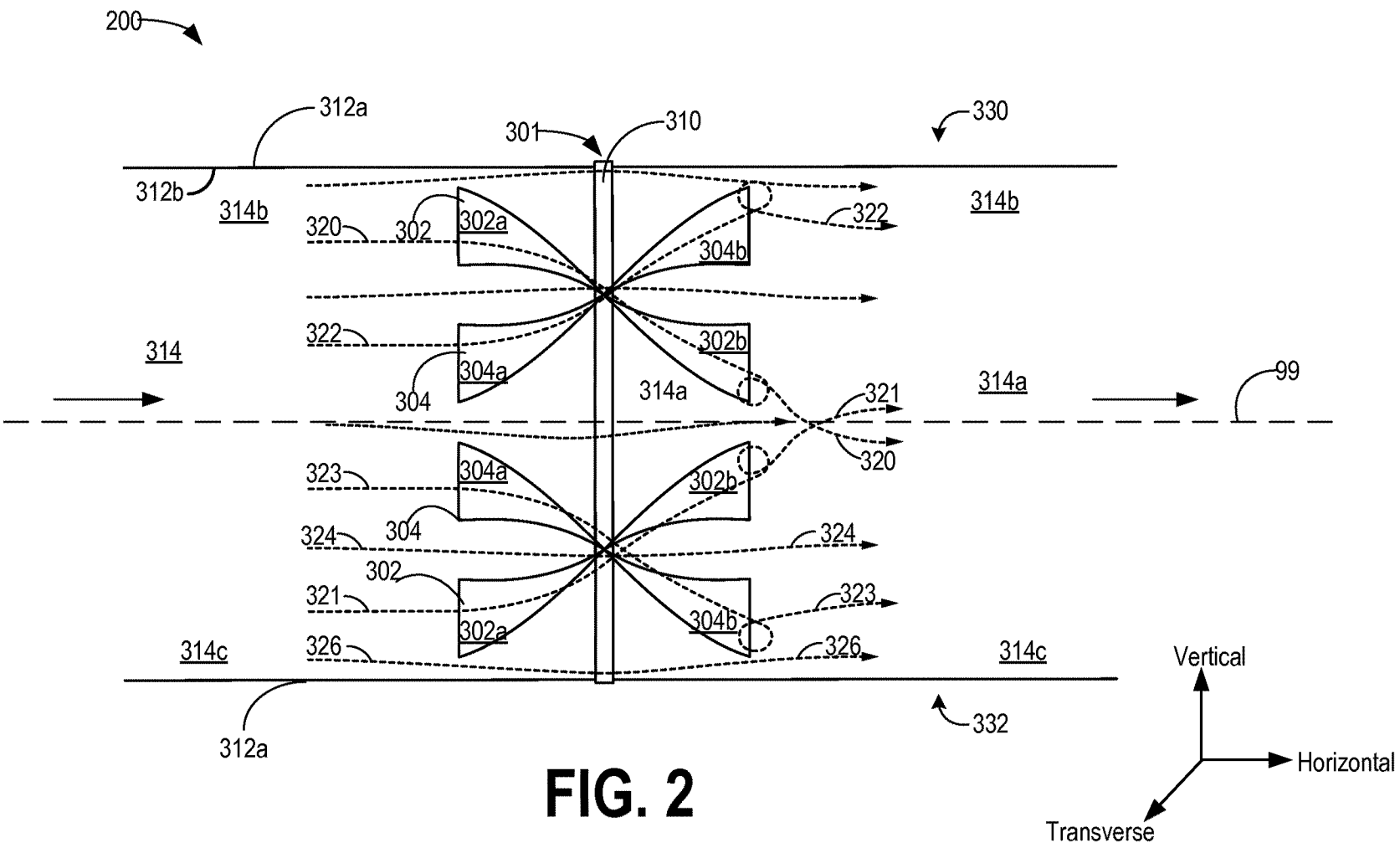
FIG. 2 shows an example of exhaust gas flow through a static flow mixer with a plurality of open and curved channels, housed within an exhaust passage.
Figure 3:
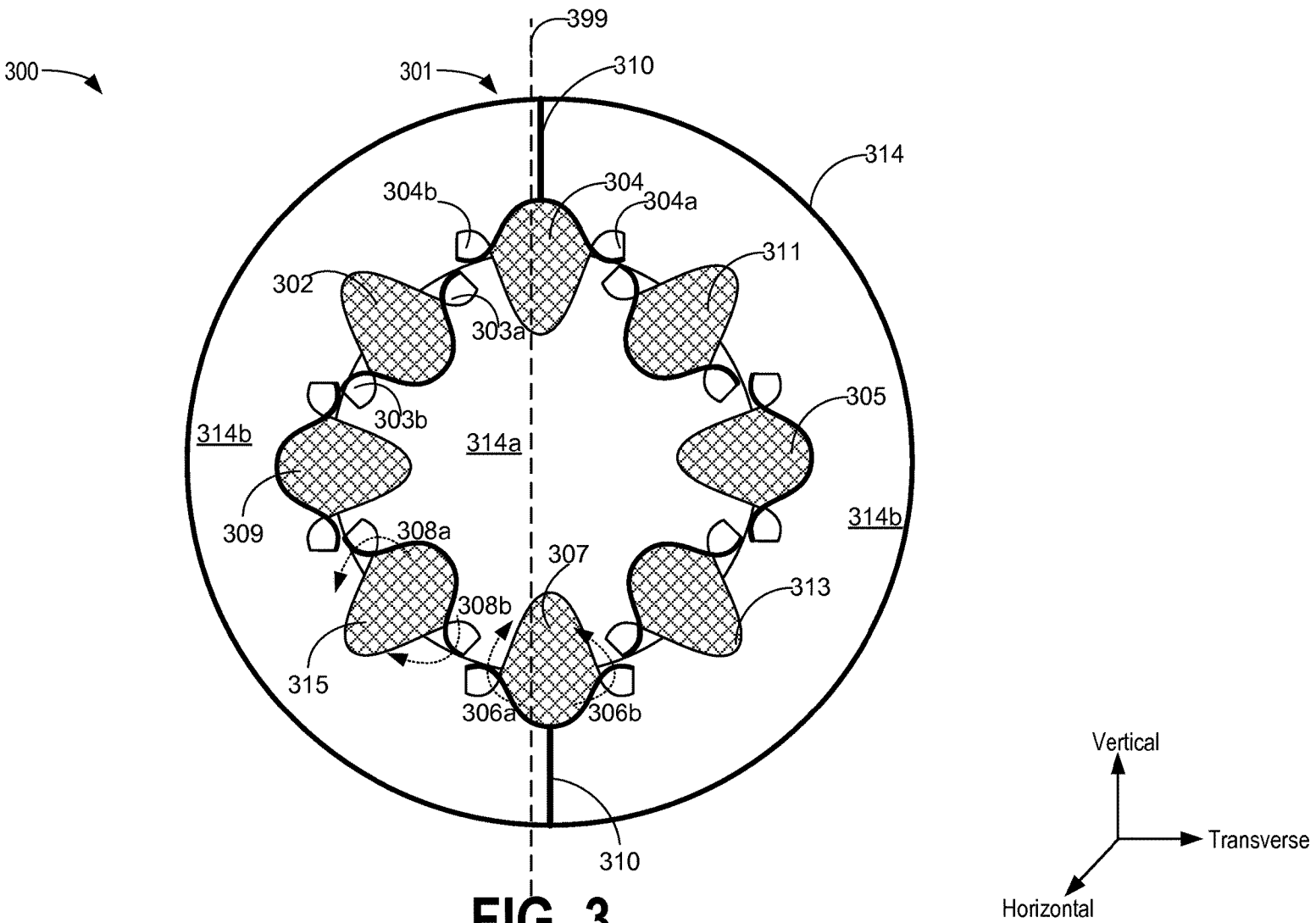
FIG. 3 shows a rear-view of the static flow mixer channel outlets with lobes, housed inside the exhaust passage.
Figure 4:
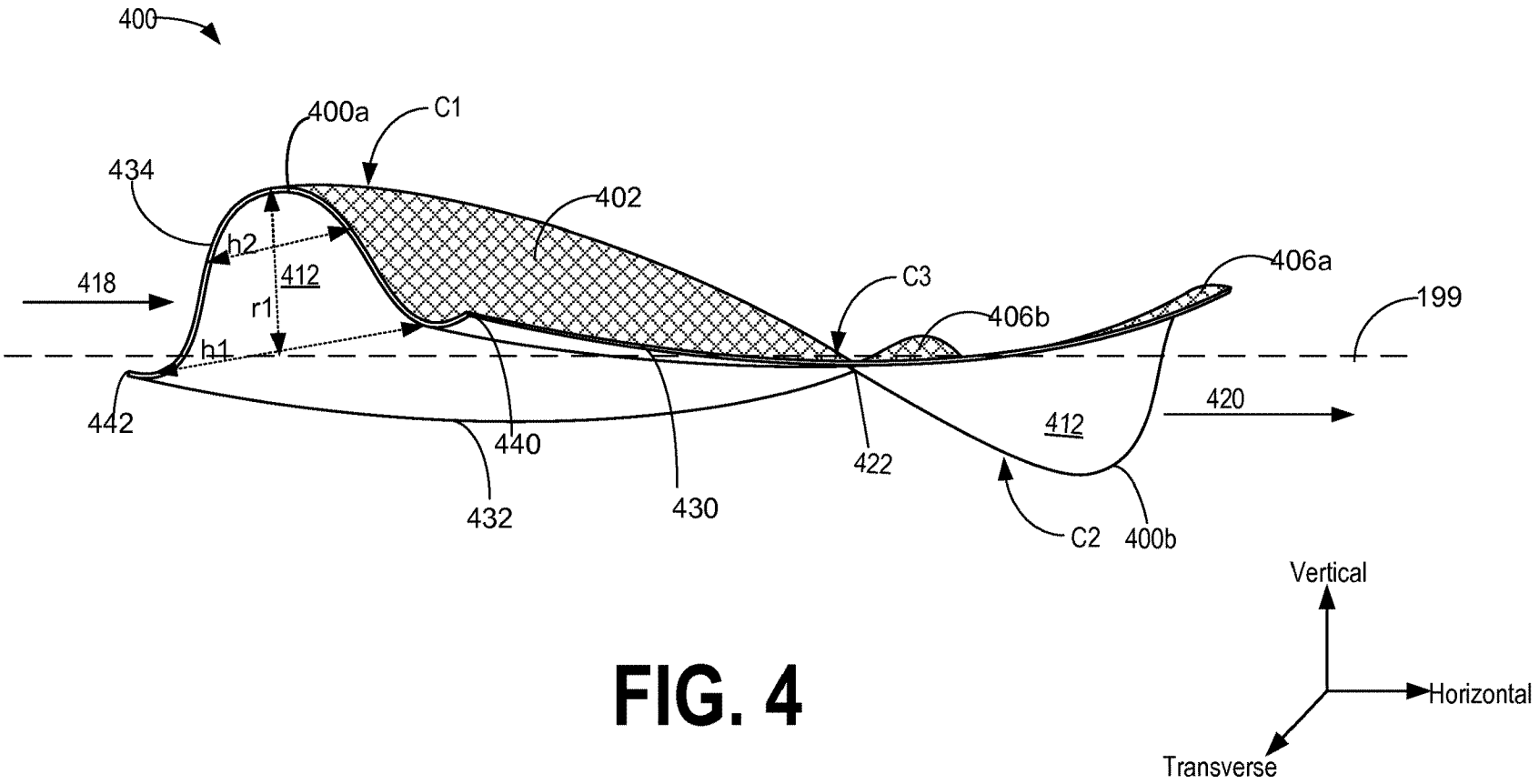
FIG. 4 shows an open and curved converge channel of the static mixer of FIG. 2.
Figure 5:
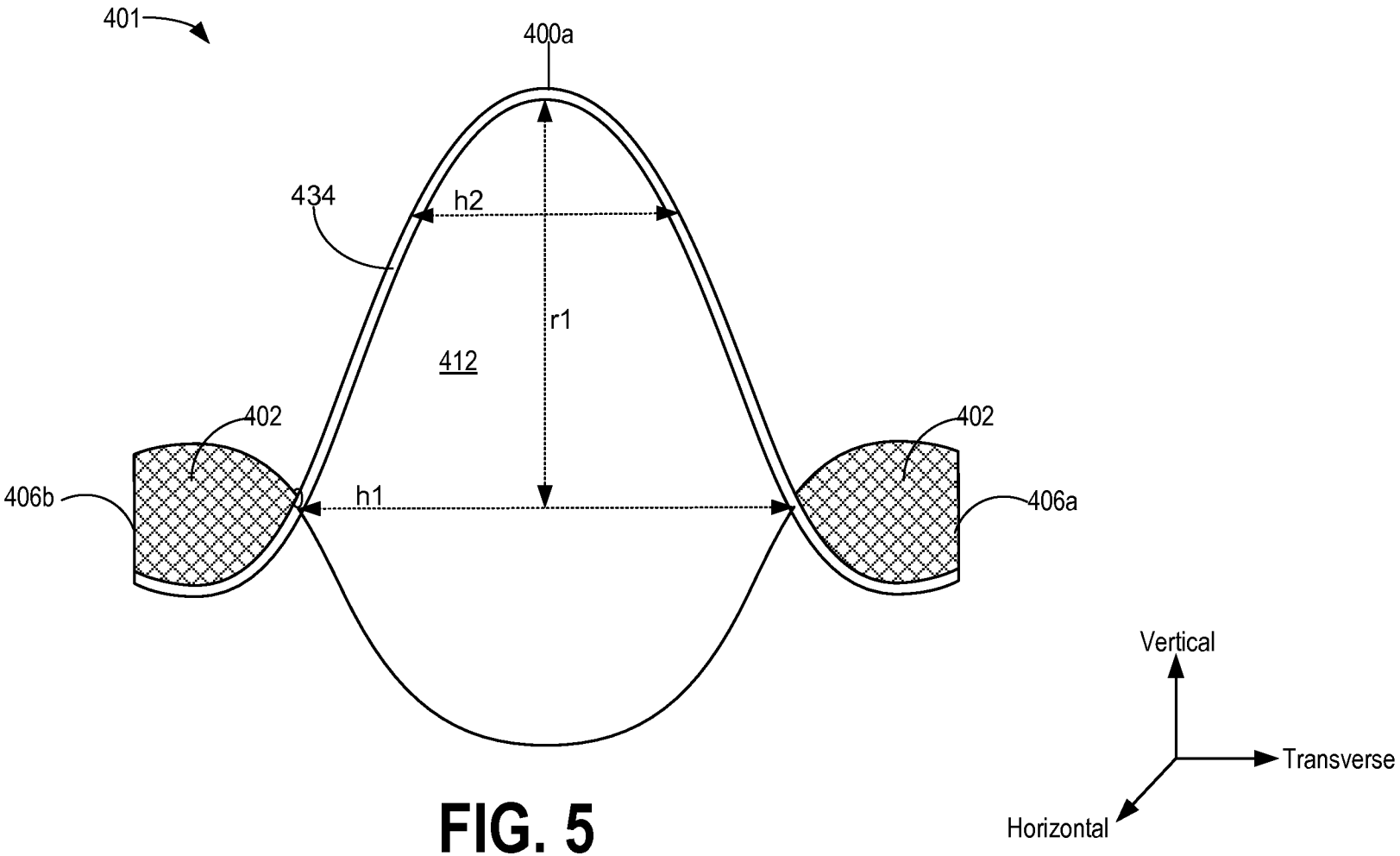
FIG. 5 shows a front view of exhaust inlet of the converge channel of FIG. 4.
Figure 6:
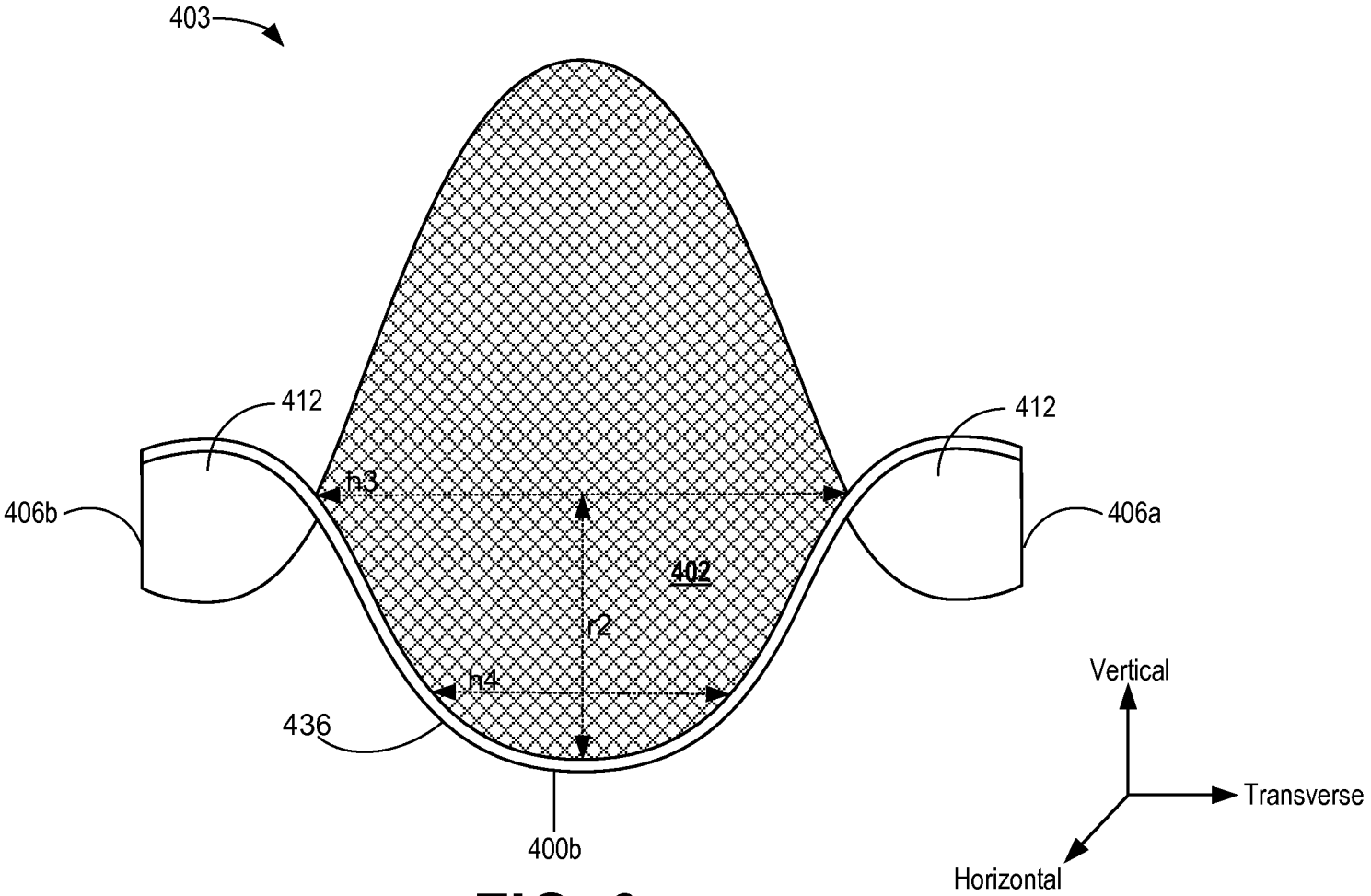
FIG. 6 shows a rear view of exhaust outlet the converge channel of FIG. 4.
Figure 7:
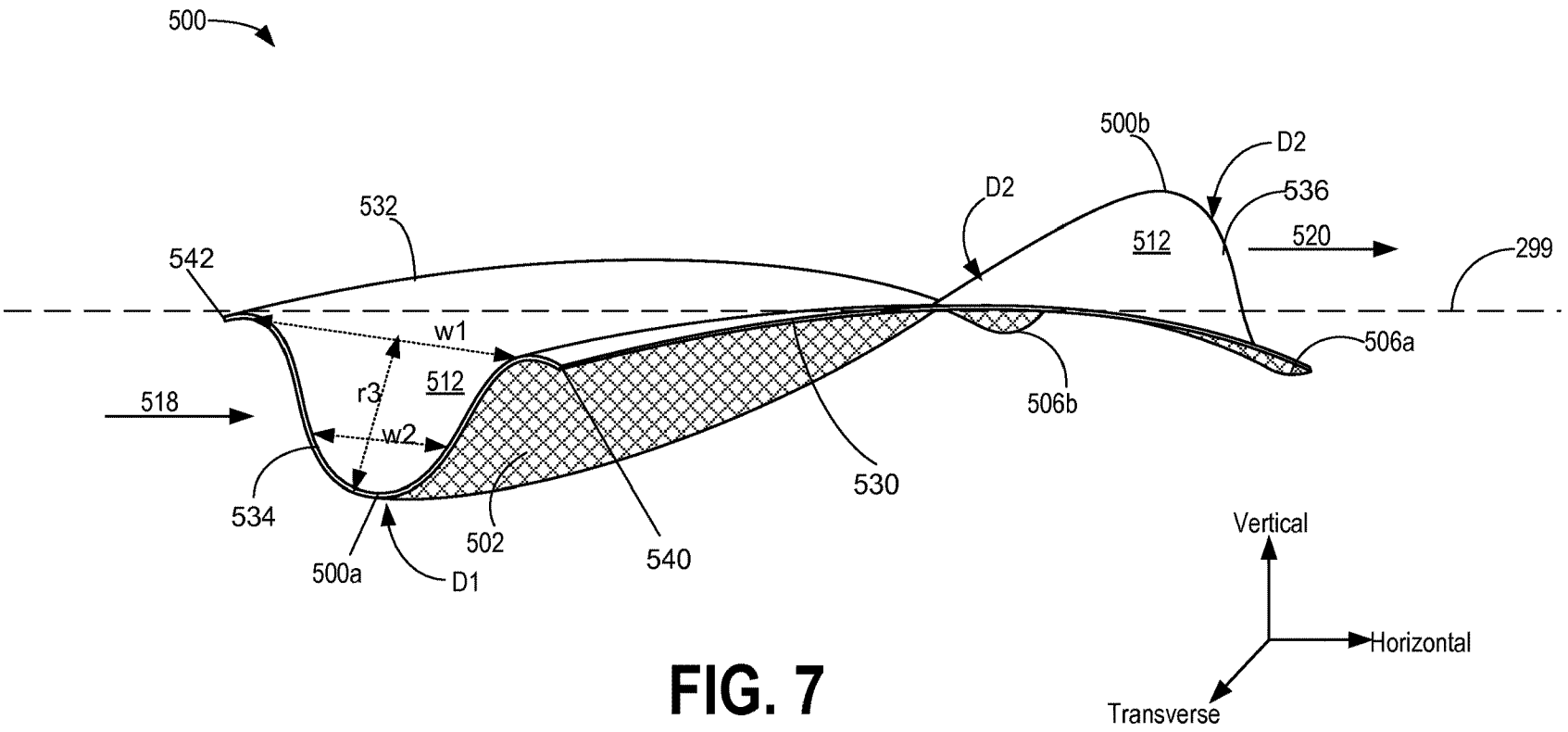
FIG. 7 shows an open and curved diverge channel of the static mixer of FIG. 2.
Figure 8:
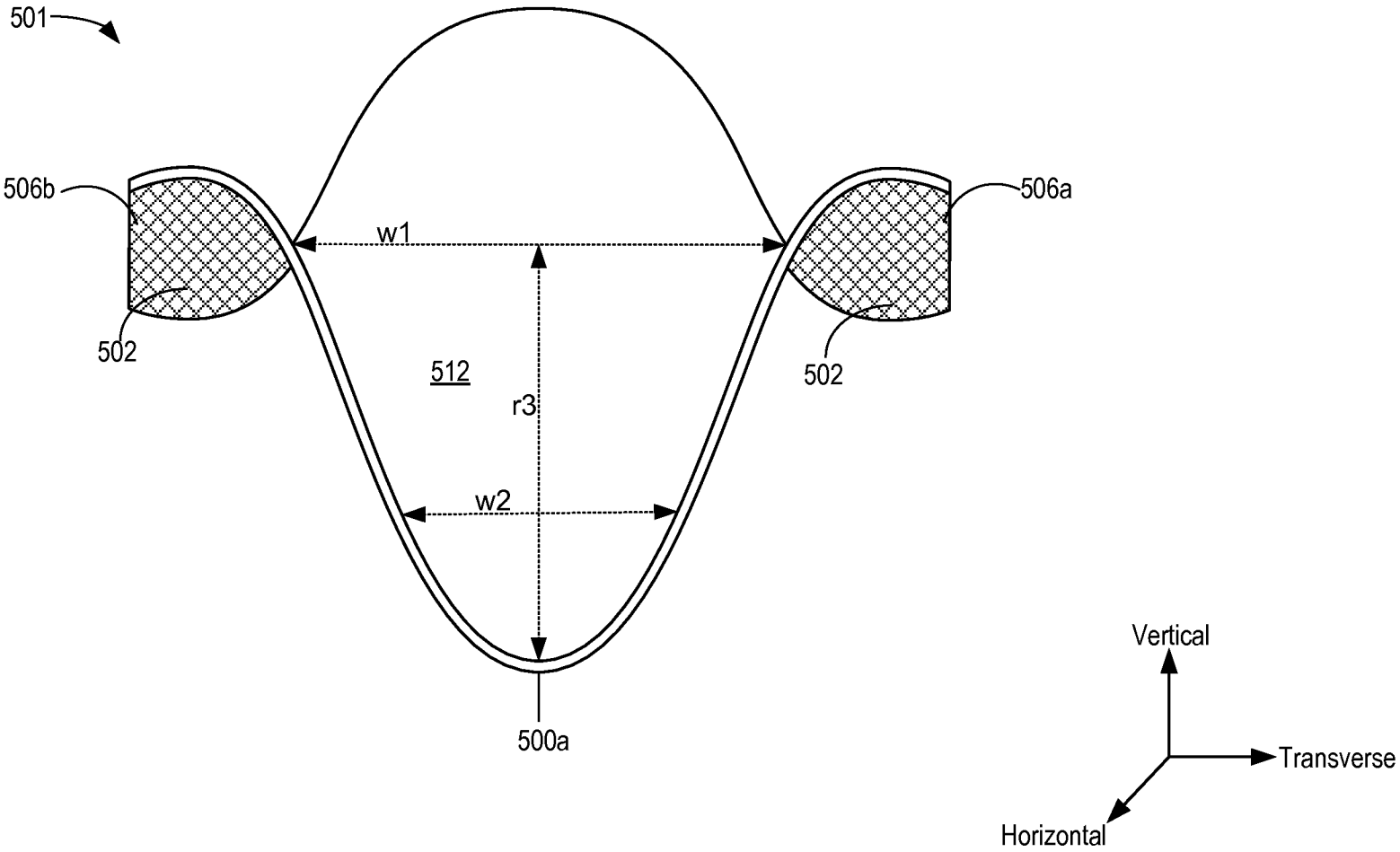
FIG. 8 shows a front view of the exhaust inlet of the diverge channel of FIG. 6.
Figure 9:
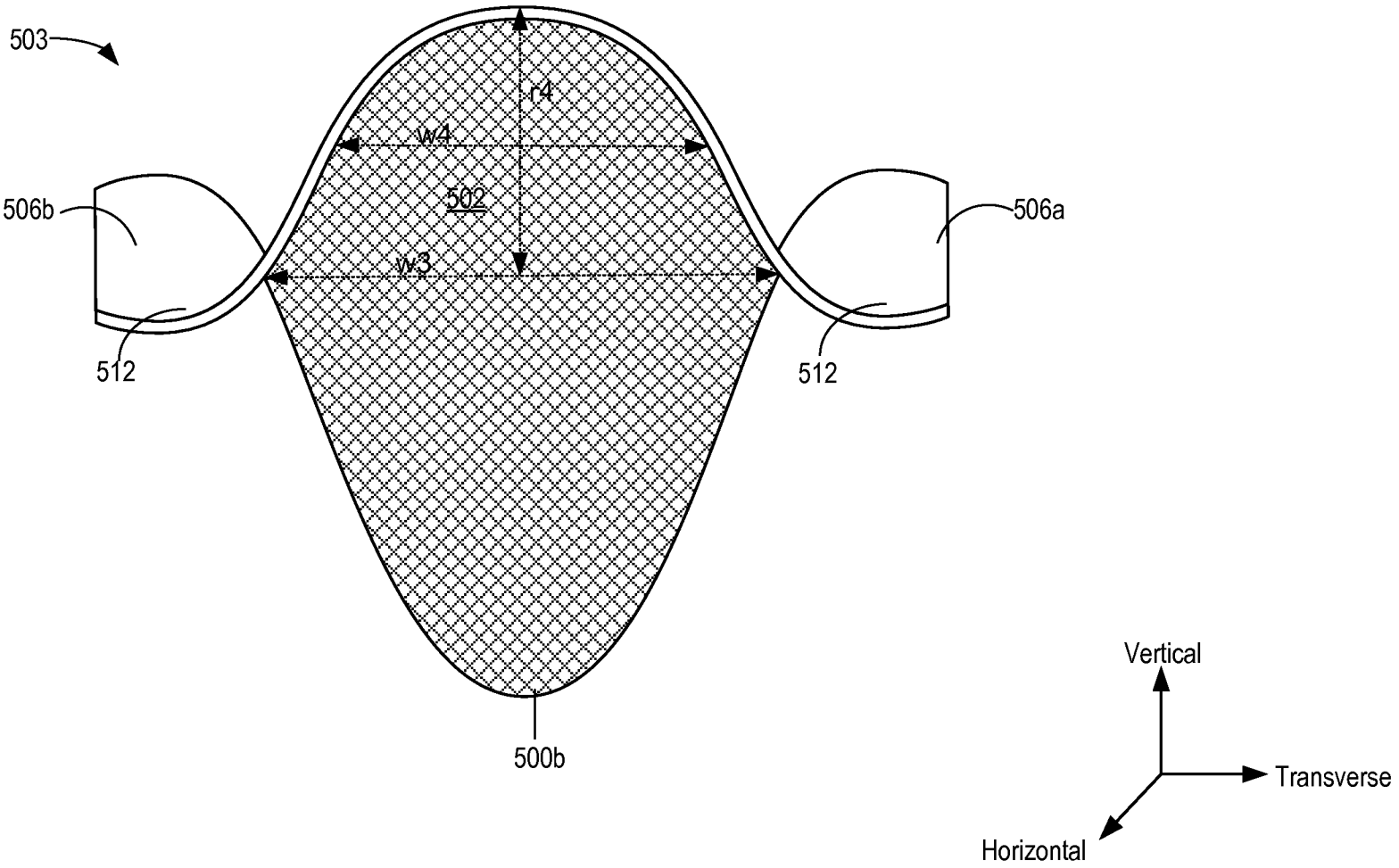
FIG. 9 shows a rear view of the exhaust outlet of the diverge channel of FIG. 6.
Figure 10:
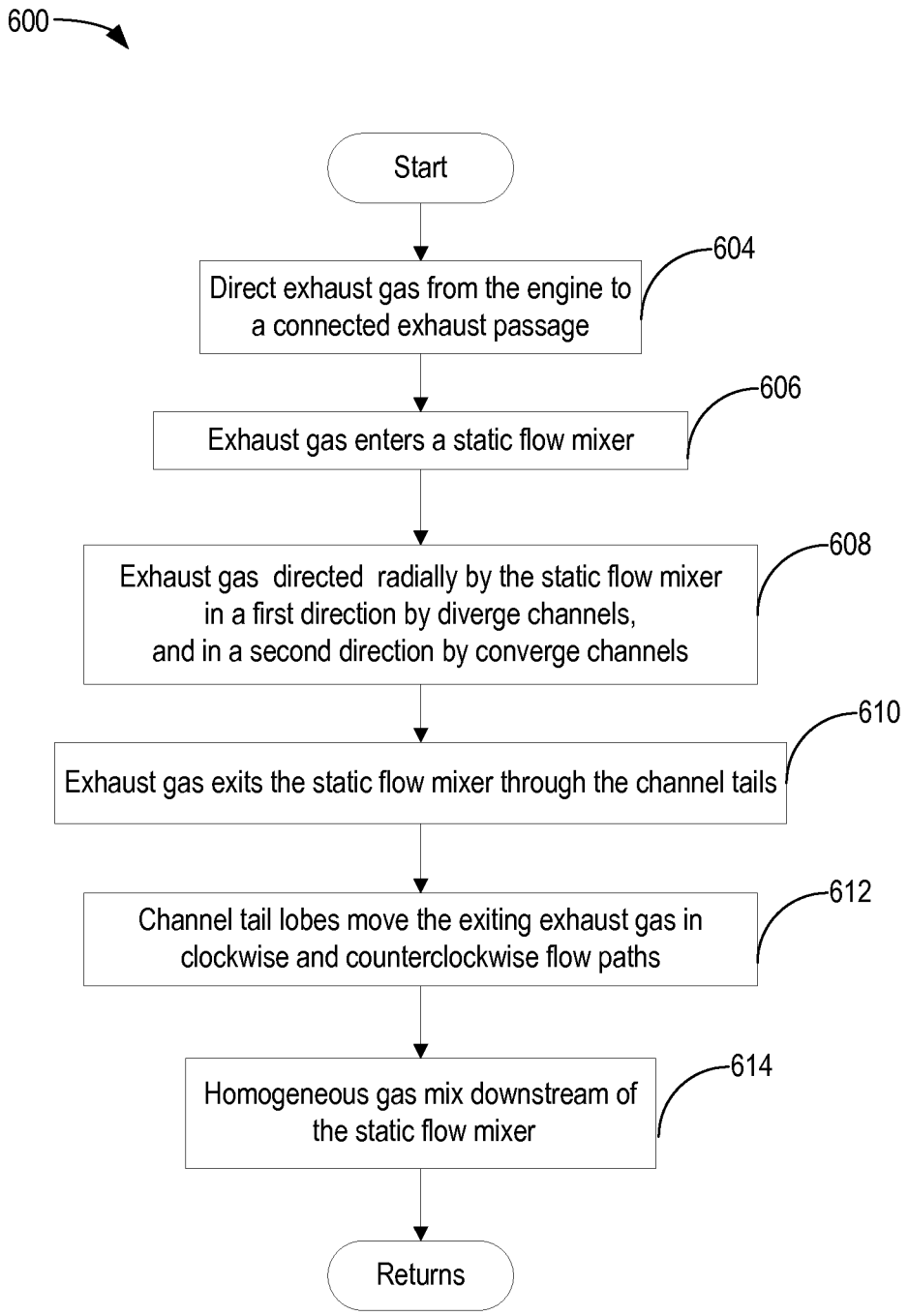
FIG. 10 shows an example method directing exhaust gas through a static flow mixer.

The following description relates to systems and methods for homogeneous mixing of exhaust gas by a static flow mixer housed within a vehicle exhaust passage. An example of a vehicle engine with an associated exhaust passage housing a gas mixer is shown in FIG. 1. Also shown in FIG. 1 are various sensors, actuators, and treatment devices used to measure or interact with the exhaust gas. In order to obtain accurate measurements of the composition of the exhaust gas, it is desired to increase the homogeneity of the exhaust gas. A static flow mixer housed inside the exhaust passage may direct the exhaust gas through a plurality of converge channels and diverge channels, therein moving the exhaust gas in multiple directions to provide robust mixing of the exhaust gas. One example of an exhaust gas flow through a static flow mixer with a plurality of open and curved channels housed inside an exhaust passage is shown in FIG. 2. A view of the static flow mixer channel outlets with lobes, housed inside the exhaust passage is depicted in FIG. 3. A view of an open and curved converge channel is shown in FIG. 4. The front view and the rear view of the converge channel of FIG. 4 are shown in FIGS. 5 and 6, respectively. The diverge channel is shown in FIG. 7 and the front view and the rear view of the diverge channel are shown in FIGS. 8 and 9, respectively. An example method of mixing gas in the exhaust passage via the static flow mixer with converge and diverge channels is shown in FIG. 10.

FIGS. 2-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. FIGS. 2-9 are drawn to scale, although other relative dimensions may be used.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a cranksupport 40 so that reciprocating motion of the piston is translated into rotational motion of the cranksupport. The cranksupport 40 may be coupled to at least one drive wheel of a vehicle via an intermediate transmission system. Further, a starter motor may be coupled to the cranksupport 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass airflow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of both the exhaust gas sensor 126 and a mixer 68. The device 70 may be a three-way catalyst (TWC), $NO_x$ trap, selective catalytic reductant (SCR), various other emission control devices, or combinations thereof. In some examples, during operation of the engine 10, the emission control device 70 may be periodically reset by operating at least one cylinder of the engine within a particular air-fuel ratio.

The mixer 68 is shown upstream of the emission control device 70 and the exhaust gas sensor 126. In some embodiments, additionally or alternatively, a second exhaust gas sensor may be located downstream of the emission control device and/or the mixer may be located downstream of the exhaust gas sensor and immediately upstream of the emission control device. The mixer 68 may perturb an exhaust flow such that a homogeneity of an exhaust gas mixture is increased as the exhaust gas flows through the mixer 68. The mixer 68 will be described in further detail below, such as with regard to FIGS. 2-9.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of cranksupport 40; throttle position from a throttle position sensor 65; and manifold absolute pressure (MAP) signal from the sensor 122. An engine speed signal may be generated by the controller 12 from cranksupport position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the cranksupport position sensor 118, which is also used as an engine speed sensor, may produce a predetermined number of equally spaced pulses every revolution of the cranksupport.

The storage medium read-only memory 106 can be programmed with computer readable data representing non-transitory instructions executable by the processor 102 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller.

FIG. 1 depicts an example system comprising a static flow mixer 68. An example of a static flow mixer that may be housed within the exhaust passage 48 associated with the engine 10 is illustrated in FIGS. 2-9. The static flow mixer housed in the exhaust passage may mix the exhaust gas to ensure a more homogeneous distribution of gas constituents, increasing gas sensor accuracy and preventing degradation of vehicle emission.

Referring to FIG. 2, a side-view of a system 200 including a static flow mixer 301 with a central support 310 mounted inside an exhaust passage 314 of a vehicle is shown. The static flow mixer 301 may be the mixer 68 depicted in FIG. 1. The exhaust passage 314 may have a center longitudinal axis 99. Vertical, horizontal, and transverse axes for the system 200 are also depicted, where the horizontal axis is parallel to the longitudinal axis of the exhaust passage and the vertical axis is perpendicular to the longitudinal axis. The exhaust passage 314 may include an inner wall 312*b* facing an interior of the exhaust passage 314 and an outer wall 312*a* opposite to and in face-sharing contact with the inner wall defining the exhaust passage 314 to flow the exhaust gas from a connected engine. The exhaust passage 314 may include a center area 314*a* and peripheral areas 314*b* and 314*c*, adjacent to the inner wall of the exhaust passage 314. The exhaust gas may enter the exhaust passage 314 and move along the exhaust passage 314 in the direction indicated by the arrows. The exhaust passage may have a top side 330 and a bottom side 332 opposite the top side. While in some examples the exhaust passage may be circular, it is to be understood that the top side may be the vertically highest side/surface of the exhaust passage and the bottom side may be the vertically lowest side/surface of the exhaust passage, relative to the ground on which a vehicle system housing the exhaust passage rests.

The static flow mixer 301 may include a plurality of open and curved channels. The open and curved channels may include a plurality of converge channels 302 and a plurality of diverge channels 304 coupled to the common central support 310 of the exhaust mixer 301. The central support 310 is configured to couple to the exhaust passage 314, wherein each open channel has a top surface facing toward the top side of the exhaust passage and a bottom surface opposite the top surface. The common central support 310 may be anchored to the exhaust passage 314 inner wall, fixing the static flow mixer 301 inside the exhaust passage 314. In one example, the central support 310 may extend along the vertical axis of the exhaust passage 314, perpendicular to the center longitudinal axis 99 of the exhaust passage 314. In one example, the plurality of converge channels 302 and diverge channels 304 may be radially coupled to the central support 310, although other configurations are possible. For example, the central support may extend along the transverse axis and/or the converge and diverge channels may be linearly or axially coupled to the support (e.g., in one or more straight lines).

Each converge channel 302 may include an exhaust gas inlet head 302*a* and an exhaust gas outlet tail 302*b*, as illustrated in FIG. 2. Similarly, each diverge channel 304 may include an exhaust gas inlet head 304*a* and an exhaust gas outlet tail 304*b*. Each converge channel 302 may flow the exhaust gas entering through the converge channel exhaust inlet head 302*a* and exiting though the converge channel exhaust outlet tail 302*b*, thereby moving gas from the peripheral areas 314*b* and/or 314*c* of the exhaust passage 314 to the center area 314*a* of the exhaust passage 314. An example of a flow path 320 entering though the converge channel head 302*a* and exiting through the converge channel tail 302*b* directing the exhaust gas from the periphery 314*b* to the center 314*a* of the exhaust passage 314 is illustrated in FIG. 2. Similarly, an example flow path 321 may move exhaust gas along the converge channel 302 from the periphery 314*c* to the center 314*a* of the exhaust passage 314. Conversely, a plurality of diverge channels 304 coupled to the central support 310 of static flow mixer 301 may guide the flow of gas from the center area 314*a* towards the peripheral area 314*a* or 314*b* of the exhaust passage 314. Example flow paths 322 and 323 illustrate the flow of gas along the diverge channels 304 from the center 314*a* to the periphery 314*b* and the periphery 314*c* of the exhaust passage 314, respectively. Besides flow paths 320 and 321 through the converge channels 302 and the flow paths 322 and 323 through the diverge channels 304, gas may also flow through the exhaust passage 314 without entering the converge and/or diverge channels, as illustrated by flow paths 324 and 326 in FIG. 2. The converge channel tails 302*b* and the diverge channels tails 304*b* may have projecting lobes that may move the gas flow exiting through the tails of the channels in a clockwise and anti-clockwise direction. The lobes on the converge channel tails and the diverge tails are discussed in details in FIGS. 4-9.

The converge channels 302 and the diverge channels 304, illustrated in FIG. 2, are open and curved channels. In one example, the converge channels 302 and diverge channels 304 may traverse along the longitudinal axis 99 of the exhaust passage 314 (e.g., the converge channels and diverge channels may each have a longitudinal axis that is parallel to a longitudinal axis of the exhaust passage). In another example, each converge channel 302 may be angled relative to the longitudinal axis towards the center axis 99 of the exhaust passage, and each diverge channel 304 may be angled relative to the longitudinal axis away from the longitudinal axis 99, curving the channels in relation to the exhaust passage 314 longitudinal axis 99. Further description of the curved configuration of the converge channels 302 and diverge channels 304 is discussed in FIGS. 4 and 7, respectively.

The static flow mixer 301 may be a single machined piece or may be welded together and may be made of material capable of being bent and curved to form the static flow mixer 301. The mixer 301 may be made of one or more ceramic materials, a metal alloy, a silicon derivative, or other suitable materials capable of withstanding the high temperatures of the exhaust gas. Additionally or alternatively, the mixer 301 may comprise of one or more coatings and materials such that exhaust may contact surfaces of the mixer 301 without depositing soot or other exhaust gas components on the mixer 301. In some embodiments, the exhaust passage 314 may include more than one mixer 301. For example, the exhaust passage 314 may have two static flow mixers 301. In one embodiment, there may be no components located between a first mixer and a second mixer in the exhaust passage. In other embodiments, the first mixer and the second mixer may be separated by one or more exhaust components, such as exhaust gas composition sensors.

FIG. 3 illustrates a rear-view of the static flow mixer 301 with four converge channels 302, 311, 313, and 315 and four diverge channels 304, 305, 307 and 309 arranged radially on the central support 310 and housed inside the exhaust passage 314. However, other numbers of converge and/or diverge channels are possible, such as three converge channels and three diverge channels. In one embodiment, the converge channels and the diverge channels may be alternatingly arranged to the central support 310, such that one converge channel may be positioned intermediate two diverge channels and vice versa. The central support 310 with the converge and diverge channels may be inserted and fixed to the exhaust passage inner wall, parallel to a vertical axis 399 of the exhaust passage 314. In one embodiment, the central support 310 may include two contact points/areas configured to couple with the inner wall of the exhaust passage 314. In one example, the central support may be continuous and traverse the diameter of the exhaust passage 314. In other embodiments, the central support 310 may not traverse the entire diameter of the exhaust passage.

In an example, the converge channels and diverge channels coupled to the central shaft 310 may be oriented such that each channel may follow the curvature of the inner wall of the exhaust passage 314, as illustrated in FIG. 3. For example, the diverge channel 304 may be oriented with its transverse axis angled at 90° relative to a vertical axis 399 of the exhaust passage 314. The diverge channel 305 may be oriented at an angle of 0°, parallel to the vertical axis 399. The diverge channel 307 may be oriented with its transverse axis angled at 90° (e.g., but flipped vertically relative to diverge channel 304), relative to the vertical axis 399 of the exhaust passage 314. The fourth diverge channel 309 may be oriented with its transverse axis angled at 0° relative to the vertical axis 399 of the exhaust passage 314. In other examples, the converge channels and diverge channels may be coupled to the central shaft in other orientations, such as each converge channel and each diverge channel having the same respective orientation relative to each other. For example, each converge channel may be oriented with each respective transverse axis at the same orientation.

The view 300 shows the channel outlets/tails from the downstream end of the exhaust passage 314 housing the static flow mixer 301 (e.g., downstream in an exhaust gas flow direction). In one example, the tail of the converge channel 302 may include a converge channel tail first lobe 303*a* and a converge channel tail second lobe 303*b*. Similarly, the tail of the diverge channel 304 may include a diverge channel tail first lobe 304*a* and a diverge channel tail second lobe 304*b*. As illustrated in FIG. 2, the exhaust gas exits the channels through the channel tails. In one example, the lobes of the diverge channel 307 tail may direct the gas exiting the diverge channel in an anticlockwise flow path 306*a* and in a clockwise flow path 306*b*, mixing the gas exiting the tail. The lobes of the converge channel 315 tail may similarly move the exiting exhaust gas in an anticlockwise flow path 308*a* and in a clockwise flow path 308*b*. The radial flow paths illustrated in FIG. 2 in combination with the flow paths generated by the lobes at the channel tails illustrated in FIG. 3 may result in a more homogeneous distribution of constituents in the gas exiting the static flow mixer versus the gas entering the static flow mixer.

An example converge channel and an example diverge channel of the static flow mixer (e.g., the static flow mixer 301 of FIGS. 2 and 3) are illustrated in details in FIGS. 4-9. An open and curved converge channel 400 along a center longitudinal axis 199 is illustrated in FIG. 4. Vertical, transverse, and horizontal axes of the converge channel 400 are also depicted. The converge channel 400 housed inside a flow passage (e.g., exhaust passage) may channel fluid (e.g., exhaust gas) from a peripheral area of the flow passage to a central area of the flow passage. The converge channel 400 may be comprised of a single piece of bent material, and may include a channel head 400*a* defining an inlet 418 and a channel tail 400*b* defining an outlet 420, opposite the inlet 418. The gas may enter the converge channel 400 through the inlet 418 on the converge channel head 400*a* and move along the length of the converge channel 400 to exit through the converge channel tail 400*b*. A front view 401 of the converge channel head 400*a* with the inlet 418 is shown in FIG. 5 and a rear view 403 of the exhaust converge channel tail 400*b* with the outlet 420 is illustrated in FIG. 6. For purpose of discussion, FIGS. 4-6 will be described collectively.

The converge channel may include a first long side 430 and a second long side 432, running along the entirety of the length of the converge channel 400, parallel to the longitudinal axis 199. The converge channel 400 may include a first short side 434 at the converge channel head 400*a* and a converge channel second short side 436 at the converge channel tail 400*b*. The first short side 434 and the second short side 436 may extend along the transverse axis, perpendicular to the longitudinal axis 199. The first long side 430 and the second long side 432 of the converge channel 400 may not come in face-sharing contact with each other along the length of the converge channel, thereby not enclosing the passage through the converge channel 400, making it an open channel. In one example, the first long side 430 and the second long side 432 may be parallel to each other along the length of the converge channel 400, defining the open converge channel without enclosing the passage along the converge channel. Additionally, the first short side 434 and the second short side 436 may not be in face-sharing contact with each other or with the first long side 430 and the second long side 432 of the converge channel 400, except at the corners of the channel where the first short side meets the first and second long sides and where the second short side meets the first and second long sides. Any surface along the first short side 434 may not have face-sharing contact with any other surface on the first short side 434. Similarly, any surface along the second short side 436 may not have face-sharing contact with any other surface along the length of the second short side 436. In one example, the edge of first long side 430 meeting the edge of the first short side 434 may curve out as a first flap 440 and the edge of the second long side 432 meeting the edge of first short side 434 may curve out as a second flap 442. The converge channel 400 may include a top surface 402 and a bottom surface 412 opposite the top surface 402. The top surface 402 may face the same direction along the entirety of the channel. Likewise, the bottom surface may face the same direction along the entirety of the channel. For example, when the static flow mixer is installed in an exhaust passage, the top surface 402 of the converge channel 400 may be facing the inner wall of the exhaust passage and the bottom surface 412 may be facing the center of the exhaust passage along an entirety of the converge channel 400. The top surface 402 and the bottom surface 412 of the converge channel 400 may bend in relation to the longitudinal axis 199 of the converge channel 400 to give the channel a curved configuration. The curved configuration of the converge channel 400 may enable the channeling of gas from a peripheral area of an associated flow passage to the center area of the flow passage, as illustrated by example flow paths 320 and 321 in FIG. 2.

The converge channel 400 may be curved by bends along multiple axes of the channel, such that the channel head 400*a* may be in a vertically upward plane and the channel tail 400*b* may be in a vertically downward plane in relation to the longitudinal axis 199. Thus, the gas entering the channel head 400*a* at one plane may exit the channel tail 400*b* in a different plane, thereby enabling converging and mixing of gas in an associated flow passage. In one example shown in FIG. 4, the converge channel 400 may include three bends. A converge channel first bend C1 may bend the channel in a downward direction along the vertical axis approaching the longitudinal axis 199 and a converge channel second bend C2 may bend the channel in an upward direction along the vertical axis, approaching the longitudinal axis 199. A converge channel third bend C3 may bend the channel along the transverse axis at a transition junction 422 of the converge channel first bend C1 and the converge channel second bend C2.

The converge channel first bend C1 may bend the top surface 402 in a downward direction with respect to the vertical axis and along the longitudinal axis 199, resulting in a concave curvature of the head relative to a plane along the vertically lowest position of the head. As a result of the first bend C1 in the downward direction, the first long side 430 and the second long side 432 of the converge channel 400 that run the length of the channel are positioned vertically higher at the head of the channel than at the middle of the channel. Along the length of the first bend C1 toward the transition region 422, the degree of bending may decrease until the middle and long sides of the channel are at the same vertical position.

The first short side 434 of the converge channel 400 may curve vertically downward towards the longitudinal axis 199. The angle of the converge channel first bend C1 may determine depth r1 of the converge channel head 400*a*. In one example, as the first short side 434 curves vertically downward at the first bend C1, such that the first short side 434 on either side of the first bend C1 may be separated by a width h1 at the base of the channel head 400*a* and by a width of h2 towards the top of the channel head 400*a*. In one example, the width h1 and the width h2 may be similar. In another example, the width h1 may be less than the width h2. In one example, the converge channel first bend C1 may give the channel head 400*a* an inverted U-shape, as illustrated in FIG. 5. In another example, the converge channel first bend C1 may be an inverted V-shape. In a further example, the converge channel bend C1 may be symmetrical as illustrated in FIG. 4, such that the first short side 434 along the converge channel first bend C1 may be symmetrical on both sides of the first bend C1. In another example, the converge channel first bend C1 may not be symmetrical, thereby making the channel head 400*a* curvature asymmetrical. The converge channel first bend C1 may continue along the longitudinal axis 199 to the transition junction 422, maintaining the top surface 402 as the convex surface and the bottom surface 412 as the concave surface of the converge channel 400. At the transition junction 422, the converge channel second bend C2 and the converge channel third bend C3 may intersect with the first bend C1 of the converge channel.

At the transition junction 422, the curvature of the channel may flip such that the tail has a convex curvature relative to the plane along the vertically lowest part of the head. At the transition junction 422, the converge channel second bend C2 may bend the channel upward with respect to the vertical axis and along the longitudinal axis 199. As a result of the second bend C2 in the upward direction, the two long sides of the converge channel 400 that run the length of the channel are positioned vertically higher at the tail of the channel than the middle of the channel. Along the length of the second bend C2 away from the transition region 422, the degree of bending may increase.

The converge channel second bend C2 may determine depth r2 of the channel tail 400*b*. In one example, a width h3 and a width h3 across the second short side 436 at the channel tail 400*b* may determine the curvature of the channel tail 400*b*. In one example, the second bend C2 bending the second short side 436 vertically upwards may result in the width h3 being equal to the width h4, giving the channel tail 400*b* a U-shape curvature. In other examples, the curvature of the second bend C2 may be a V-shape or other suitable curvature. In one example, the depth r1 of the channel head 400*a* may be identical to the depth r2 of channel tail 400*b*. In another example, the width h1 and width h2 at the channel head 400*a* may be equal to the width h3 and width h4 of the channel tail 400*b*, respectively.

The transition from the first bend C1 to the second bend C2 may result in the converge channel third bend C3 at the transition junction 422, where the third bend C3 bends the channel in a transverse direction. The third bend C3 may bend the converge channel 400 in an upward direction relative to the vertical axis, such that the top surfaces 402 of the converge channel head 400*a* and the converge channel tail 400*b* are brought toward each other. However, in some examples the angle of the third bend C3 may be 0°.

In one example, the transition junction 422 may be equidistant from channel head 400*a* and channel tail 400*b*. In other examples, the transition junction 422 may be closer to the channel head 400*a* or may be closer to the channel tail 400*b*. In the illustrated example, the transition junction 422 may be located at 60% the length of the converge channel 400 with respect to the channel head 400*a*, and as such the converge channel head may be longer than the converge channel tail. In one example, the converge channel head 400*a* may be closer to the inner wall of the exhaust passage 314, such that the longer channel head may transfer a large volume of exhaust gas from the periphery to the center of the exhaust passage 314. The location of the transition junction 422 along the length of the converge channel 400 may determine the location of the channel at which the top surface 402 and bottom surface 412 may reverse in orientation (for example, from convex to concave). The example described above is a non-limiting example of a converge channel. The converge channel may have additional and/or alternate bends to curve the converge channel such that it may channel gas from a peripheral area to a central area of an associated flow passage.

In addition to moving the gas from peripheral area to a center area, the converge channel may also move the gas exiting the channel tail in a clockwise and in a counter-clockwise direction. The channel tail 400*b* may include a first lobe 406*a* and a second lobe 406*b* to circulate the gas exiting the channel tail. In one embodiment, the first lobe 406*a* and the second lobe 406*b* may be formed by curving out of a section of the top surface 402, away from the longitudinal axis 199 at the converge channel tail 400*b*, forming two lobes on either side of the tail as shown in FIG. 6. The span of the lobes 406*a* and 406*b* may be determined by the angle and the area of the top surface 402 curving out of the channel tail 400*b* ends. In one example, the first lobe and the second lobe may be triangular flaps that may be substantially straight relative to the bending of the tail. In one example, the two lobes may be symmetrical such that span of the two lobes may be identical and opposite (for example, the first lobe 406*a* may be a mirror image of the second lobe 406*b*). In another example, the lobes 406*a* and 406*b* may have different span. The span length of the converge channel tail lobes may be approximately one fifth of the total channel width. The tail lobes may be relatively flat with minimal to no curvature at both edges of the tail lobe.

The converge channel first lobe 406*a* on the channel tail 400*b* may impart a swirl to the exiting gas in a counter-clockwise direction and the converge channel second lobe 406*b* may impart a swirl in the clockwise direction, mixing the gas exiting the channel tail. Due the curvature of the bottom surface 412, the exhaust gas enters the inlet at relative center location of the channel, as it flows along the bottom surface 412 it is divided into two flow paths on either side of the tail lobes. At the first lobe 406*a*, from rear view, exhaust gas may be directed from the bottom surface 412, making an anticlockwise flow path. At the second lobe 406*b*, exhaust gas may be directed from the bottom surface 412, making in a clockwise flow path.

FIGS. 7-9 illustrate a diverge channel 500 along a center longitudinal axis 299. Vertical, transverse and horizontal axes of the diverge channel 500 are also depicted. The diverge channel 500 may include a diverge channel head 500*a* and a diverge channel tail 500*b*. The gas may enter the diverge channel head 500*a* through an inlet 518 and may exit through the diverge channel tail 500*b* through an outlet 520, opposite the inlet 518. The diverge channel 500 may function to move the gas from the center area to the peripheral area of a flow passage housing the diverge channel, such as the exhaust passage 314 housing the diverge channel 304. A front view 501 of the diverge channel head 500*a* with the inlet 518 is shown in FIG. 8 and a rear view 503 of the exhaust diverge channel tail 500*b* with the outlet 520 is illustrated in FIG. 9. For purpose of discussion, FIGS. 7-9 will be described collectively.

Similar to the converge channel 400, the diverge channel 500 may be an open and curved channel, as shown in FIG. 7. However, the spatial relation of the diverge channel head 500*a* and the diverge channel tail 500*b* to the longitudinal axis 299 of the diverge channel may be reverse of the spatial relationship of the converge channel head 400*a* and converge channel tail 400*a* to the longitudinal axis 199 of the converge channel 400, as illustrated in FIG. 4. In one example, the curved configuration of the diverge channel 500 may be such that the diverge channel head 500*a* with the inlet 518 may be in a vertically downward plane in relation to the longitudinal axis 299. Along the length of the diverge channel 500, the channel may curve, such that the diverge channel tail 500*b* with the outlet 520 may be in a vertically upward plane in relation to the longitudinal axis 299 of the diverge channel 500. In one example, the channeling of gas by the diverge channel 500 may be from the periphery to the center area of an associated flow passage, as illustrated by flow paths 322 and 323 through the diverge channel 304 in FIG. 2.

The diverge channel 500 may include a first long side 530 and a second long side 532, running along the entirety of the diverge channel 500, parallel to the longitudinal axis 299. The diverge channel 500 may also include a first short side 534, bordering the diverge channel head 500*a* and a diverge channel second short side 436 bordering the diverge channel tail 500*b*. The first short side 534 and the second short side 536 may be along the transverse axis, perpendicular to the longitudinal axis 299. The first long side 530 and the second long side 532 of the diverge channel 500 may not come in contact with each other along the length of the diverge channel, thereby not enclosing the passage through the diverge channel, making it an open channel. In one example, the first long side 530 and the second long side 532 may be parallel to each other along the length of the diverge channel 500, defining the open passage of diverge channel. Additionally, the first short side 534 and the second short side 536 may not be in contact with each other or with the first long side 530 and the second long side 532 of the diverge channel 500, except at the corners of the channel where the first short side 534 meets the first long side 530 and the second long side 532 and where the second short side 536 meets the first long side 530 and the second long side 532. Any surface along the first short side 534 may not have face-sharing contact with any other surface on the first short side 534. Similarly, any surface along the second short side 536 may not have face-sharing contact with any other surface along the length of the second short side 536. In one example, the edge of first long side 530 meeting the edge of the first short side 534 may curve out as a first flap 540 and the edge of the second long side 532 meeting the edge of the short side 534 may curve out as a second flap 542. The diverge channel 500 may include a top surface 502 and a bottom surface 512 opposite the top surface 502. The top surface 502 may face the same direction along the entirety of the diverge channel. Likewise, the bottom surface 512 may face the same direction along the entirety of the channel. For example, when the static flow mixer is installed in an exhaust passage, the bottom surface 512 of the diverge channel 500 may be facing the inner wall of the exhaust passage and the top surface 502 may be facing the center of the exhaust passage along an entirety of the diverge channel 500. The top surface 502 and the bottom surface 512 of diverge channel 500 may bend in relation to the longitudinal axis 299 of diverge channel 500 to give the channel a curved configuration. The curved configuration of the diverge channel 500 may enable the channeling of gas from a center area of an associated flow passage to a peripheral area of the flow passage. Similar to the converge channel 400 described in FIGS. 4-6, the diverge channel 500 may be curved by bends on the top surface 502 and the associated bottom surface 512. However, unlike the converge channel 400, the diverge channel 500 may curve such that the diverge channel head 500*a* may be in a vertically downward plane in relation to the longitudinal axis 299 and the channel tail 500*b* may be in a vertically upward plane in relation to the longitudinal axis 299, as illustrated in FIG. 7. Thus, the gas entering the channel head 500*a* at one plane may exit the channel tail 500*b* at a different plane, thereby enabling diverging and mixing of gas in an associated flow passage.

The diverge channel 500 may be curved by bends along multiple axes of the channel. FIG. 7 illustrates an example of the diverge channel 500 including three bends. A diverge channel first bend D1 may bend the channel in an upward direction along the vertical axis approaching the longitudinal axis 299 and a diverge channel second bend D2 may bend the channel in a downward direction along the vertical axis, approaching the longitudinal axis 299. At a transition junction 522, the diverge channel first bend D1 and the diverge channel second bend D2 may be intersected by a diverge channel third bend D3 that may bend the diverge channel 500 along the transverse axis.

The diverge channel first bend D1 may bend the top surface 502 in an upward direction with respect to the vertical axis and along the longitudinal axis 299, resulting in a convex curvature. As a result of the first bend D1 in the upward direction, the two long sides of the diverge channel 500 that run the length of the channel are positioned vertically lower at the head of the channel than the middle of the channel. Along the length of the first bend D1 toward from the transition region 522, the degree of bending may decrease until the middle and long sides of the diverge channel 500 are at the same vertical position.

The angle of the diverge channel 500 first bend D1 may determine depth r3 of the diverge channel head 500*a*. The first short side 534 may curve vertically upward towards the longitudinal axis 299. In one example, the first short side 534 on either side of the of the first bend D1 may curve vertically upward approaching the longitudinal axis 299, such that the first short side 534 may be separated by a width w1 at the base of the channel head 500*a* and by a width of w2 towards the top of the channel head 500*a*. In one example, the width w1 and the width w2 may be similar. In another example, the width w1 may be less than the width w2. In one example, the diverge channel first bend D1 may give the channel head 500*a* an U-shape, as illustrated in FIGS. 7 and 8. The angle of the diverge channel first bend D1 may also determine the radius of curvature of the diverge channel head 500*a*. The diverge channel first bend D1 of the diverge channel 500 may continue along the longitudinal axis 299 to the transition junction 522, maintaining the top surface 502 as the convex surface and the bottom surface 512 as the concave surface of the diverge channel 500 up to the transition junction 522. At the transition junction 522, the diverge channel first bend D1 and the diverge channel second bend D2 may result in the diverge channel third bend D3 in a transverse direction. The diverge channel third bend D3 may bend the diverge channel 500 in a downward direction relative to the vertical axis, such that the top surface 502 of the diverge channel head 500*a* and the diverge channel tail 500*b* are brought towards each other. However, in some examples, the angle of the third bend D3 may be 0°.

At transition junction 522, the convex curvature of the head transitions to a concave curvature of the tail. At the transition junction 522, the second bend D2 may bend the channel downward with respect to the vertical axis and along the longitudinal axis 299. As a result of the second bend D2 in the downward direction, the two long sides of the diverge channel 500 that run the length of the channel are positioned vertically lower than the middle of the channel at the tail of the channel. Along the length of the second bend D2 away from the transition region 522, the degree of bending may increase.

The diverge channel first bend D1 and the diverge channel second bend D2 define the curvature, symmetry, and span of the diverge channel head 500*a* and diverge channel tail 500*b*, respectively. In one example, the angle of the diverge channel first bend D1 may be such that the diverge channel head 500*a* may have a U-shaped curvature. Similarly, the diverge channel second bend D2 may give the diverge channel tail 500*b* an inverted U-shape curvature. The diverge channel second bend D2 may determine depth r4 of the channel tail 500*b*. In one example, the second short side 536 bending on either side of the second bend D2 may be separated by a width w3 and a width w4 at the channel tail 500*b* and may determine the curvature of the channel tail 500*b*. In one example, the second bend D2 bending the second short side 536 vertically downwards may result in width w3 being equal to the width w4, giving the channel tail 500*b* a U-shaped curvature. The diverge channel first bend D1 and the diverge channel second bend D2 may be such that the depth r3 of the channel head 500*a* and the depth r4 of channel tail 500*b* of the diverge channel 500 may be identical.

In one example, the transition junction 522 may be equidistant from channel head 500*a* and channel tail 500*b*. In other examples, the transition junction 522 may be closer to the channel head 500*a* or may be closer to the channel tail 500*b*. The location of the transition junction 522 along the length of the diverge channel 500 may determine the location of the channel at which the top surface 502 and bottom surface 512 may reverse in orientation (for example, convex or concave). In the illustrated example, the transition junction 522 may be located at 60% the length of the diverge channel 500 with respect to the channel head 500*a*, and as such the diverge channel head may be longer than the diverge channel tail. The example described above is a non-limiting example of a diverge channel. The diverge channel may have additional and/or alternate bends to curve the diverge channel such that it may channel gas from a center area to a peripheral area of an associated flow passage.

Similar to the converge channel 400, the diverge channel 500 may have lobes in the diverge channel tail 500*b* to move the exiting gas at the channel tail 500*b* in a clockwise and counterclockwise direction (from rear view). A diverge channel first lobe 506*a* and a diverge channel second lobe 506*b* may be present at the diverge channel tail 500*b*, as illustrated in FIGS. 7 and 9. The first lobe 506*a* and the second lobe 506*b* of the diverge channel 500 may be formed by the bottom surface 512 of the diverge channel curving out, away from the longitudinal axis 299. The span of the diverge channel tail lobes 506*a* and 506*b* may be determined by the angle and surface area of the bottom surface 512 curving out at the diverge channel tail 500*b*. In one embodiment, the first lobe 506*a* and the second lobe 506*b* may be symmetrical such that the span of the two lobes may be identical and opposite (for example, the first lobe 506*a* may be a mirror image of the second lobe 506*b*). In another example, the lobes 506*a* and 506*b* may have different spans. The diverge channel tail lobes may include a triangular flap that may be substantially straight relative to the bending of the tail. The span length of the tail lobes may be approximately one fifth of the total channel width. The tail lobes may be relatively flat with minimal to no curvature at both edges of the tail lobe.

The length of the channels may range from 50 mm to 80 mm and the width of the channels may range from 10 mm to 20 mm, depending on the diameter of the exhaust passage. In both the converge and the diverge channels, there may be two different types of bends, a first type of bend may be along the center of the channel in longitudinal direction (in horizontal-vertical plane), for example the first bend C1 of the converge channel 400 and the first bend D1 of the diverge channel 500, which forms the inverted U-shape or the U-shape of the channel heads, respectively. A second type of bend (for example, the bend C2 and D2 of the converge channel and diverge channel, respectively) may be in a vertical-horizontal plane, forming the U-shape at the converge channel tail and an inverted U-shape at the diverge channel tail. A third bend may be present along the transverse plane at the transition junction of the head and the tail of the channels. In one example, the third bend C3 of the converge channel 400 and the third bend D3 of the diverge channel 500, may be minimal, for example at an angle of 0°.

Thus, a combination of converge channels and diverge channels coupled to a central support may be mounted in a flow passage to enable mixing of gas in the flow passage. The channeling of gas from the periphery to the center of the flow passage by the converge channels and from the center to the periphery by the diverge channels, along with mixing of the gas in a clockwise and counterclockwise direction by the lobes at the channel tails may result in a more homogenous gas mix in the flow passage housing the static flow mixer.

FIG. 10 shows an example method 600 of mixing gas by a static flow mixer mounted in an exhaust passage connected to a vehicle engine. The method 600 is a non-limiting example method of mixing exhaust gas by a static flow mixer housed in an exhaust passage. The method 600 may be adapted for mixing gas by the static flow mixer in any flow passage, including engine and non-engine flow passages. The static flow mixer may include a plurality of converge channels and a plurality of diverge channels mounted on a central support. The channels may include a channel head for entry of gas and a channel tail for exit of gas from the channel. The channel tails may include two lobes on either side of the channel tail to further mix the gas exiting the channels.

At 604, the method includes directing the exhaust gas from an engine to a connected exhaust passage. The exhaust gas may enter the exhaust passage upstream of any associated flow mixers and gas sensors. At 606, the exhaust gas may enter a static flow mixer housed in the exhaust passage. The static flow mixer may include a plurality of open and curved channels and the exhaust gas may enter the channels through the channel heads. The open and curved channels may be a plurality of converge channels and a plurality of diverge channels. After the exhaust gas enters the static flow mixer through the channel heads, the method 600 may proceed to 608, where the exhaust gas may be channeled radially by the static flow mixer. To mix the gases radially, the static mixer may direct exhaust gas in a first direction via a set of diverge channels of the flow mixer. The diverge channels may direct the exhaust gases from the center to the periphery of the exhaust passage housing the static flow mixer. The static mixer may direct the exhaust gas in a second direction via a set of converge channels of the flow mixer, directing exhaust gas toward a central region of the exhaust passage.

At 610, the exhaust gas may proceed to exit the static flow mixer through the channel tails. At 612, the lobes on the channel tails may move the exiting exhaust gas flow via clockwise and counterclockwise flow paths created at each respective tail of the set of diverge channels and the set of converge channels. At 614, a more homogeneous exhaust gas mix may be present in the downstream of the static flow mixer compared to the gas mix upstream of the static flow mixer. The exhaust mix may proceed towards gas sensors and/or emission control devices housed in the exhaust passage downstream of the static flow mixer. For example, the exhaust gas mix after exiting the static flow mixer may proceed towards a $NO_2$ sensor, a HC sensor etc. and may pass though emission control devices, such as SCR units, all housed in the exhaust passage downstream of the static flow mixer. The exhaust passage may also house gas sensors both upstream and downstream of the static flow mixer, such that the exhaust gas composition may be evaluated by the upstream gas sensors before entering the static flow mixer and by the downstream gas sensors after the exhaust gas exits the static flow mixer. In one example, more than one static flow mixer may be housed in the exhaust passage.

Thus, the exhaust gas passing through a static flow mixer housed in the exhaust passage receiving exhaust gas from an associated engine may be mixed radially by the static flow mixer diverge and converge channels. Additionally, the lobes at the tails of the channels may direct the exhaust gas in a clockwise and a counterclockwise direction, resulting in a more homogeneous gas mix downstream of the static flow mixer housed in the exhaust passage.

The technical effect of using the above described static flow mixer in an exhaust passage is that a more homogenous gas mix is delivered to gas sensors housed in the exhaust passage downstream of the static flow mixer, which may be ideal for accurate sensor output. Accurate measurement of exhaust gas compounds may increase the efficiency of exhaust treatment systems, such as Selective Catalytic Reduction (SCR) units, associated with the exhaust passage, thereby reducing degradation of vehicle emission.

One embodiment of a flow mixer includes a plurality of open channels coupled to a central support structure, a plurality of open channels coupled to a central support structure, each open channel of the plurality of open channels having a head bending in a first direction along a longitudinal axis, a tail bending in a second direction along the longitudinal axis, and set of lobes at the tail. A first example of the flow mixer includes, the plurality of open channels comprising of at least one diverge channel and least one converge channel. A second example of the flow mixer optionally includes the first example, and further includes, wherein at least one converge channel and at least one diverge channel are of equal length. A third example of the flow mixer optionally includes one or more of the first and the second examples, and further includes, wherein, for each of the at least one diverge channel, the head bending in the first direction comprises the head bending in a downward direction and the tail bending in the second direction comprises the tail bending in an upward direction. A fourth example of the flow mixer optionally includes one or more of the first through third examples, and further includes wherein, for each of the at least one converge channel, the head bending in the first direction comprises the head bending in an upward direction and the tail bending in the second direction comprises the tail bending in a downward direction. A fifth example of the flow mixer optionally includes one or more of the first through fourth examples, and further includes, wherein the at least one diverge channel is angled at a first angle with respect to the central support structure and the at least one converge channel is angled at a second angle, opposite the first angle, with respect to the central support structure, the first angle including the head of the at least one diverge channel oriented toward a center of the central support structure and the tail of the at least one diverge channel oriented away from the center. A sixth example of the flow mixer optionally includes one or more of the first through fifth examples, and further includes, wherein each lobe of the set of lobes comprises a triangular flap that is substantially straight relative to the bending of the tail. A seventh example of the flow mixer optionally includes one or more of the first through sixth examples, and further includes, wherein the head transitions into the tail at a transition region of the open channel, and wherein the head bends in the first direction along an entirety of the head and the tail bends in the second direction along an entirety of the tail. An eighth example of the flow mixer optionally includes one or more of the first through seventh examples, and further includes, wherein the central support structure is configured to couple to a flow passage having a top and a bottom, wherein each open channel has a top surface facing toward the top of the flow passage and a bottom surface opposite the top surface, and wherein each top surface of each open channel faces toward the top of the passage along an entirety of each respective open channel. A ninth example of the flow mixer optionally includes one or more of the first through eighth examples, and further includes, wherein the flow passage is an exhaust passage positioned to receive exhaust gas from an engine. A tenth example of the flow mixer optionally includes one or more of the first through ninth examples, and further includes, wherein the head of each open channel defines a flow inlet configured to receive exhaust gas, and wherein the tail of each open channel defines a flow outlet configured to expel exhaust gas. An eleventh example of the flow mixer optionally includes one or more of the first through tenth examples, and further includes, wherein the plurality of converge channels and diverge channels are coupled to the central support structure in a radial configuration.

In one embodiment, a system comprises an exhaust passage having an interior wall and configured to receive exhaust gas flow from an engine; and a flow mixer positioned within the exhaust passage and comprising a set of diverging flow channels configured to direct exhaust gas flow from a central region of the exhaust passage toward the interior wall, and a set of converging flow channels configured to direct exhaust gas flow from the interior wall toward the central region, each flow channel comprising a head defining an exhaust gas inlet and a tail defining an exhaust gas outlet, each tail configured to impart rotational momentum to the exhaust gas flow. A first example of the system includes, wherein each head of each diverging flow channel curves in a first direction along a diverging flow channel longitudinal axis and each tail of each diverging flow channel curves in a second direction along the diverging flow channel longitudinal axis. A second example of the system optionally includes the first example, and further includes, wherein each head of each converging flow channel curves in the second direction along a converging flow channel longitudinal axis and each tail of each converging flow channel curves in the first direction along the converging flow channel longitudinal axis. A third example of the system optionally includes the first and/or the second examples, and further includes, wherein each diverging flow channel is angled with respect to an exhaust passage longitudinal axis toward the interior wall in an exhaust flow direction and each converging flow channel is angled with respect to the exhaust passage longitudinal axis toward the central region. A fourth example of the system optionally includes one or more or each of the first example through the third examples, and further includes, wherein the flow mixer is a first flow mixer and wherein the system further comprises a second flow mixer positioned in the exhaust passage. A fifth example of the system optionally includes one or more or each of the first through the fourth examples, and further includes, wherein a gas sensor is located between the first flow mixer and the second flow mixer in the exhaust passage.

An example method of a static flow mixer radially mixing an exhaust gas flow from an engine via a flow mixer, includes directing exhaust gas in a first direction via a set of diverge channels of the flow mixer and directing exhaust gas in a second direction via a set of converge channels of the flow mixer, and further includes mixing the exhaust gas flow via clockwise and counterclockwise flow paths created at each respective tail of the set of diverge channels and the set of converge channels. The method may further include, wherein directing exhaust gas in the first direction comprises directing exhaust gas towards an interior wall of an exhaust passage coupled to the engine and housing the flow mixer, and wherein directing exhaust gas in the second direction comprises directing exhaust gas toward a central region of the exhaust passage.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A flow mixer, comprising:

a plurality of open channels coupled to a central support structure, each open channel of the plurality of open channels having a head bending in a first direction along a longitudinal axis of an exhaust passage, a tail bending in a second direction along the longitudinal axis, and a set of lobes at the tail, and where each of the plurality of open channels is parallel to the longitudinal axis along which exhaust gas flows.

2. The flow mixer of claim 1, wherein the plurality of open channels comprises at least one diverge channel and at least one converge channel, and where the at least one diverge channel and the at least one converge channel are oppositely arranged about the central support structure.

3. The flow mixer of claim 2, wherein the at least one converge channel and the at least one diverge channel are of equal length, and where the at least one converge channel moves exhaust gas from peripheral areas to a center area of the exhaust passage and where the at least one diverge channel moves exhaust gas from the center area to peripheral areas of the exhaust passage.

4. The flow mixer of claim 2, wherein, for each of the at least one diverge channel, the head bending in the first direction comprises the head bending in a downward direction and the tail bending in the second direction comprises the tail bending in an upward direction.

5. The flow mixer of claim 2, wherein, for each of the at least one converge channel, the head bending in the first direction comprises the head bending in an upward direction and the tail bending in the second direction comprises the tail bending in a downward direction.

6. The flow mixer of claim 2, wherein the at least one diverge channel is angled at a first angle with respect to the central support structure and the at least one converge channel is angled at a second angle, opposite the first angle, with respect to the central support structure, the first angle including the head of the at least one diverge channel oriented toward a center of the central support structure and the tail of the at least one diverge channel oriented away from the center.

7. The flow mixer of claim 1, wherein each lobe of the set of lobes comprises a triangular flap that is substantially straight relative to the bending of the tail.

8. The flow mixer of claim 1, wherein the head transitions into the tail at a transition region of each open channel, and wherein the head bends in the first direction along an entirety of the head and the tail bends in the second direction along an entirety of the tail.

9. The flow mixer of claim 1, wherein the central support structure is configured to couple to a flow passage having a top and a bottom, wherein each open channel has a top surface facing toward the top of the flow passage and a bottom surface opposite the top surface, and wherein each top surface of each open channel faces toward the top of the flow passage along an entirety of each respective open channel.

10. The flow mixer of claim 9, wherein the exhaust passage is positioned to receive exhaust gas from an engine.

11. The flow mixer of claim 10, wherein the head of each open channel defines a flow inlet configured to receive exhaust gas, and wherein the tail of each open channel defines a flow outlet configured to expel exhaust gas.

12. The flow mixer of claim 1, wherein the plurality of open channels is coupled to the central support structure in a radial configuration, and where the central support structure is physically coupled to a center of each of the plurality of open channels.

13. A system, comprising:

an exhaust passage having an interior wall and configured to receive exhaust gas flow from an engine; and a flow mixer positioned within the exhaust passage and comprising a set of diverging flow channels configured to direct exhaust gas flow from a central region of the exhaust passage toward the interior wall, and a set of converging flow channels configured to direct exhaust gas flow from the interior wall toward the central region, each flow channel comprising a head defining an exhaust gas inlet and a tail defining an exhaust gas outlet, each tail configured to impart rotational momentum to the exhaust gas flow, and where the set of diverging flow channels and the set of converging flow channels each comprise longitudinal axes parallel to a longitudinal axis of the exhaust passage along which exhaust gas flows.

14. The system of claim 13, wherein each head of each diverging flow channel curves in a first direction along a diverging flow channel longitudinal axis and each tail of each diverging flow channel curves in a second direction along the diverging flow channel longitudinal axis.

15. The system of claim 14, wherein each head of each converging flow channel curves in the second direction along a converging flow channel longitudinal axis and each tail of each converging flow channel curves in the first direction along the converging flow channel longitudinal axis.

16. The system of claim 13, wherein the flow mixer is a first flow mixer, and wherein the system further comprises a second flow mixer positioned in the exhaust passage.

17. The system of claim 16, wherein a gas sensor is located between the first flow mixer and the second flow mixer in the exhaust passage.

* * * * *